US005871026A

United States Patent [19]

Lin

[11] Patent Number: 5,871,026

[45] Date of Patent: Feb. 16, 1999

[54] UMBRELLA SHAPE TWO LAYERS FOLDABLE TENT

[76] Inventor: Tu Lin, No. 10 Cui-Ping Lane, Zhen-Nan St., Ching-Shui Town, Taichung Hsien, Taiwan

[21] Appl. No.: 916,711

[22] Filed: Aug. 18, 1997

[51] Int. Cl.[6] ..... E04H 15/28

[52] U.S. Cl. ..... 135/98; 135/904; 135/124; 135/135; 135/120.3

[58] Field of Search ..... 135/98, 99, 124, 135/128, 33.7, 33.71, 120.3, 120.4, 135, 908, 904, 27, 28

[56] References Cited

U.S. PATENT DOCUMENTS

| | | | |
|---|---|---|---|
| 74,933 | 2/1868 | Palmer | 135/120.3 X |
| 2,546,228 | 3/1951 | Martini | 135/33.71 |
| 3,794,054 | 2/1974 | Watts | 135/98 |
| 4,202,363 | 5/1980 | Watts et al. | 135/126 X |
| 5,333,634 | 8/1994 | Taylor | 135/98 |
| 5,479,954 | 1/1996 | Tu | 135/98 |

FOREIGN PATENT DOCUMENTS

| | | | |
|---|---|---|---|
| 0008229 | 7/1885 | United Kingdom | 135/33.7 |

*Primary Examiner*—Carl D. Friedman
*Assistant Examiner*—Winnie S. Yip
*Attorney, Agent, or Firm*—David and Raymond; Raymond Y. Chan

[57] ABSTRACT

A two layers half automatic foldable tent is comprised of a framework, an umbrella surface, and a tent cloth. The framework is enclosed on the outside of the tent, while the umbrella surface is expanded on the framework above the tent cloth, wherein the framework is presented as an expanding structure. The opening and closing of the umbrella frame is completed by a controlling rope. Any user may easily install the tent, the lower primary frame of the umbrella frame may be folded upwards as the framework is closed, thus it may be stored conveniently and may be carried. Another, since in the present invention, the umbrella surface and tent cloth are designed as the two layers type thus the sunlight, rain water and snow will not contact the tent directly, and the people within the tent will be safe and comfortable and the lifetime of a tent is prolonged.

6 Claims, 9 Drawing Sheets

UMBRELLA SHAPE TWO LAYERS FOLDABLE TENT

BACKGROUND OF THE INVENTION

1. Field of the Invention

The present invention relates to an umbrella type two layers foldable tent, especially to a foldable tent which is easy to operate and carry, may be installed quickly, has a compact volume after being folded, and is safe, comfortable and endurable in usage.

2. Description of the Prior Art

In the prior tent, the exemplary tent is formed by a multi-nodes framework to match with connectors, wherein the framework is assembled one node by one node, and finally the tent cloth is covered. The primary defect of this tent is the complicated structure so that the assembled time is too long and too wasted, not easy to assemble and dangerous. This kind of tents are generally sold in the market.

Further, there are also some brand new tent product, such as U.S. patent application Ser. No. 5,479,954, which is appended by the inventor of the present invention, in which the original complicated assembling operation of the tent is simplified. However, in that patent application, the framework structure is slightly complicated, and for the living quality, such as the sunlight, wind and snow are not completely considered, thus there are still some points being necessary to be improved. Moreover, in U.S. patent application Ser. No. 2,864,389, a structure is disclosed in that the operating process is similar to that in aforementioned Patent Application of the inventor of the present invention, thus there still are some drawbacks about the comfort and safety. However, since the framework in that Patent Application is covered within the tent, it is not easy to be folded. Furthermore, the framework will probably penetrate through the tent cloth so that the tent will probably be destroyed. Another, U.S. patent application Ser. Nos. 420,690, 1,680, 090, 3,874,397, 4,033,366, 5,117,851, 5,216,948, in which the operation has no practically improved, it is needless to say about the comfort and safety.

SUMMARY OF THE INVENTION

Accordingly, according to said defects in the prior art, the inventor of the present invention has made much effort to improve the prior tent by his plentiful experience about tent design, and eventually, a brand new umbrella type two layers foldable tent are invented.

The main object of the present invention is to provide a foldable tent which is easy to operate and carry, may be installed quickly, has a compact volume after being folded, and is safe, comfortable and endurable in usage.

The further object of the present invention is to provide a two layers structure which may be used to isolate the umbrella surface and tent cloth. By the umbrella cloth on the upper layer, the sunlight may be isolated and the ultraviolet light or other thermal radiation may be prevented to radiate on the tent directly, thus within the tent may be sustain in a clear and comfortable state. By a buffer layer on the umbrella surface, the rain water and snow may be drain out effectively, so to prevent that the weight thereof directly applies on the tent cloth, thus the tent will collapse. Since a space is formed between the upper umbrella surface and lower tent cloth for passing through air, the wind will flow through the space, thus the pressure applied on the tent will be reduced and the tent is prevented to collapse.

Another characteristic of the present invention is that the framework is installed on the outside of the tent cloth and the framework present a mode of extending and closing of the umbrella frame. In using, the user only needs to pull the controlling rope, thus the installation of the tent may be completed easily. Meanwhile as the framework in the present invention is released, it is unnecessary to rearrange with much effort, thus tent will be folded in order easily and quickly.

Besides, the distal end of the upper primary frame is bent upwards slightly as the lower primary frame is bent downwards, they will contact directly so that the tensile force of the lower primary frame will not directly contact with the connector so that the connector will destroy and the pressure resistance of the tent in the present invention is greatly improved.

DESCRIPTION OF THE DRAWINGS

The present invention will be better understood and its numerous objects and advantages will become apparent to those skilled in the art by referencing to the following drawings in which.

DETAILED DESCRIPTION OF THE PREFERRED EMBODIMENT

Figure 1:
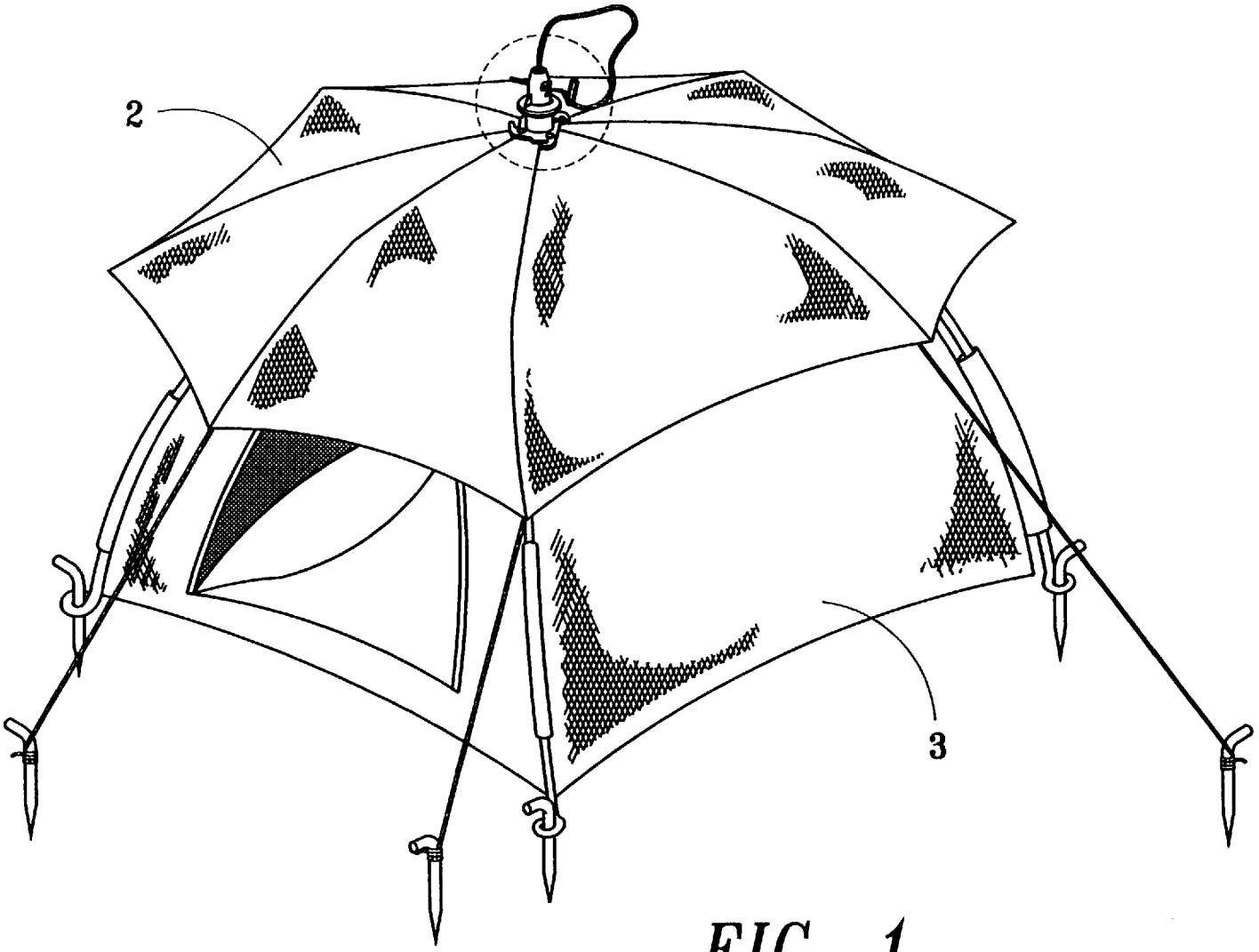
FIG. 1 is the perspective view of the present invention.
Figure 1A:
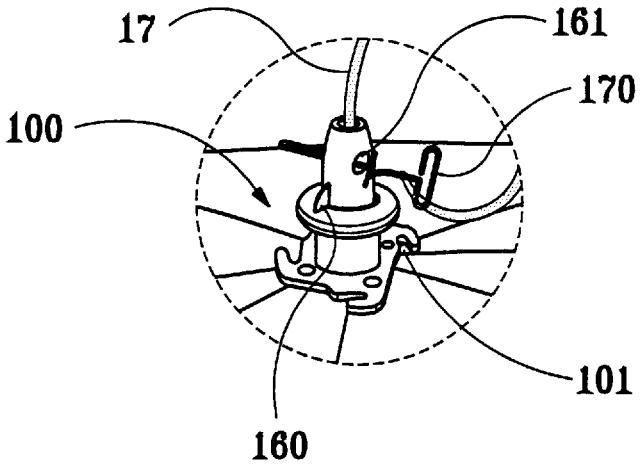
FIG. 1(A) is an enlarged perspective view of the fixing ring of the present invention.
Figure 2A:
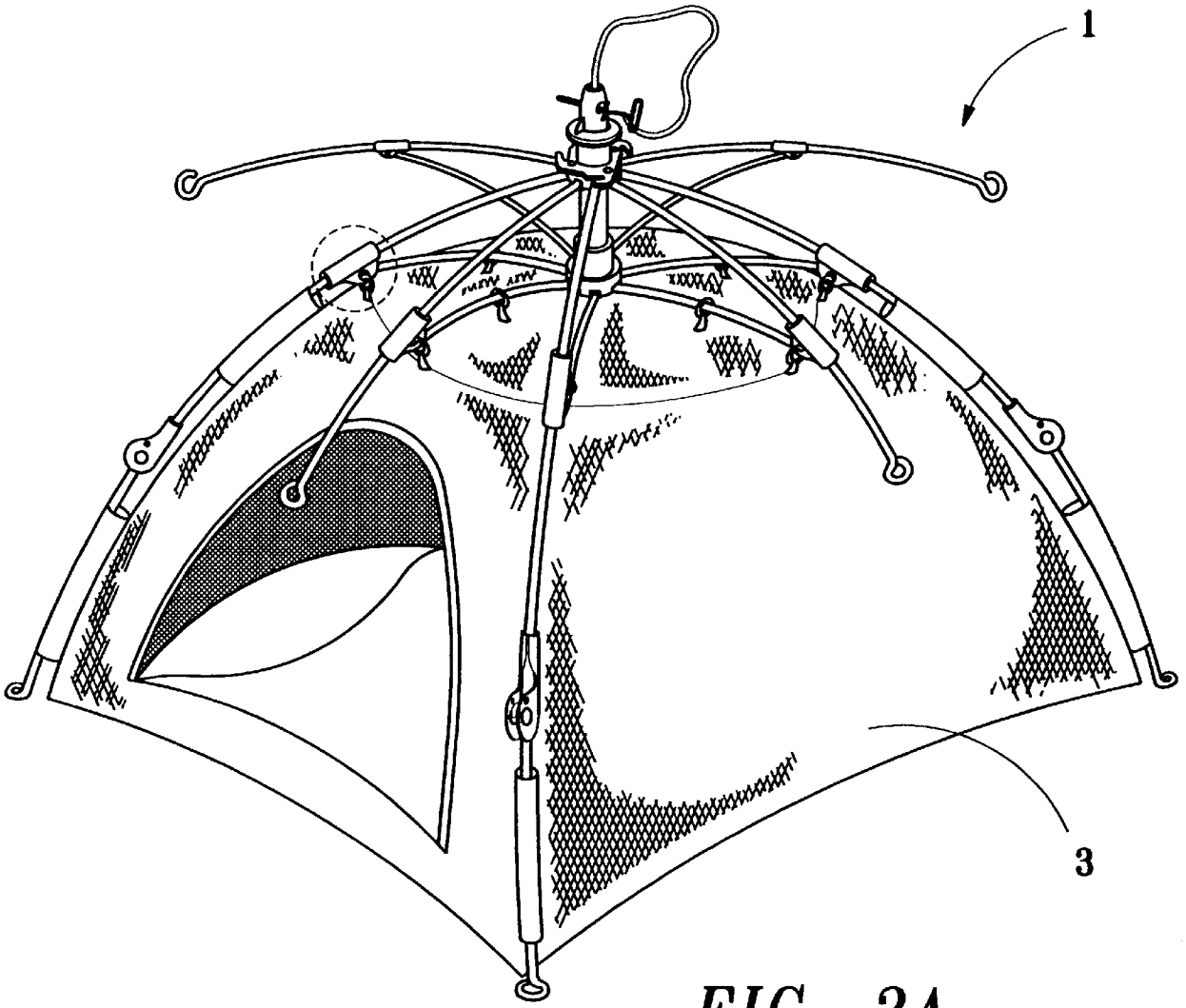
FIG. 2(A) shows the installing example of the present invention.
Figure 2B:
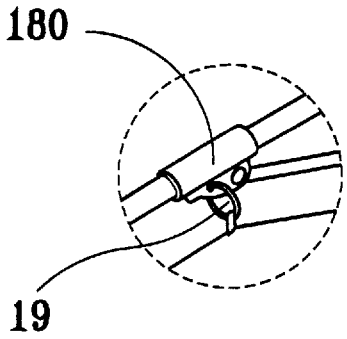
FIG. 2(B) is an enlarged perspective view to show the hook of the present invention.
Figure 2C:
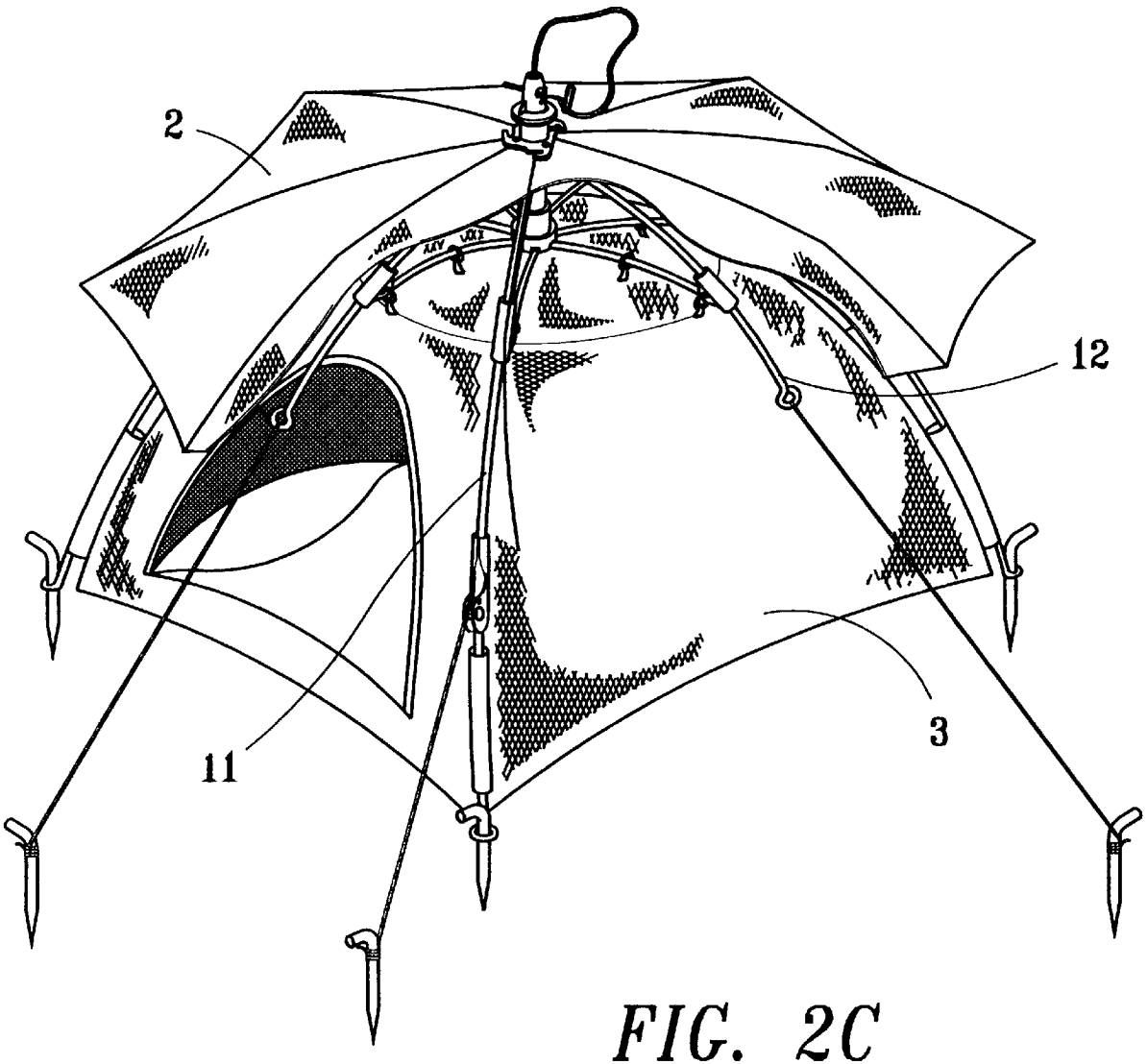
FIG. 2(C) shows the installing example of the present invention.
Figure 3:
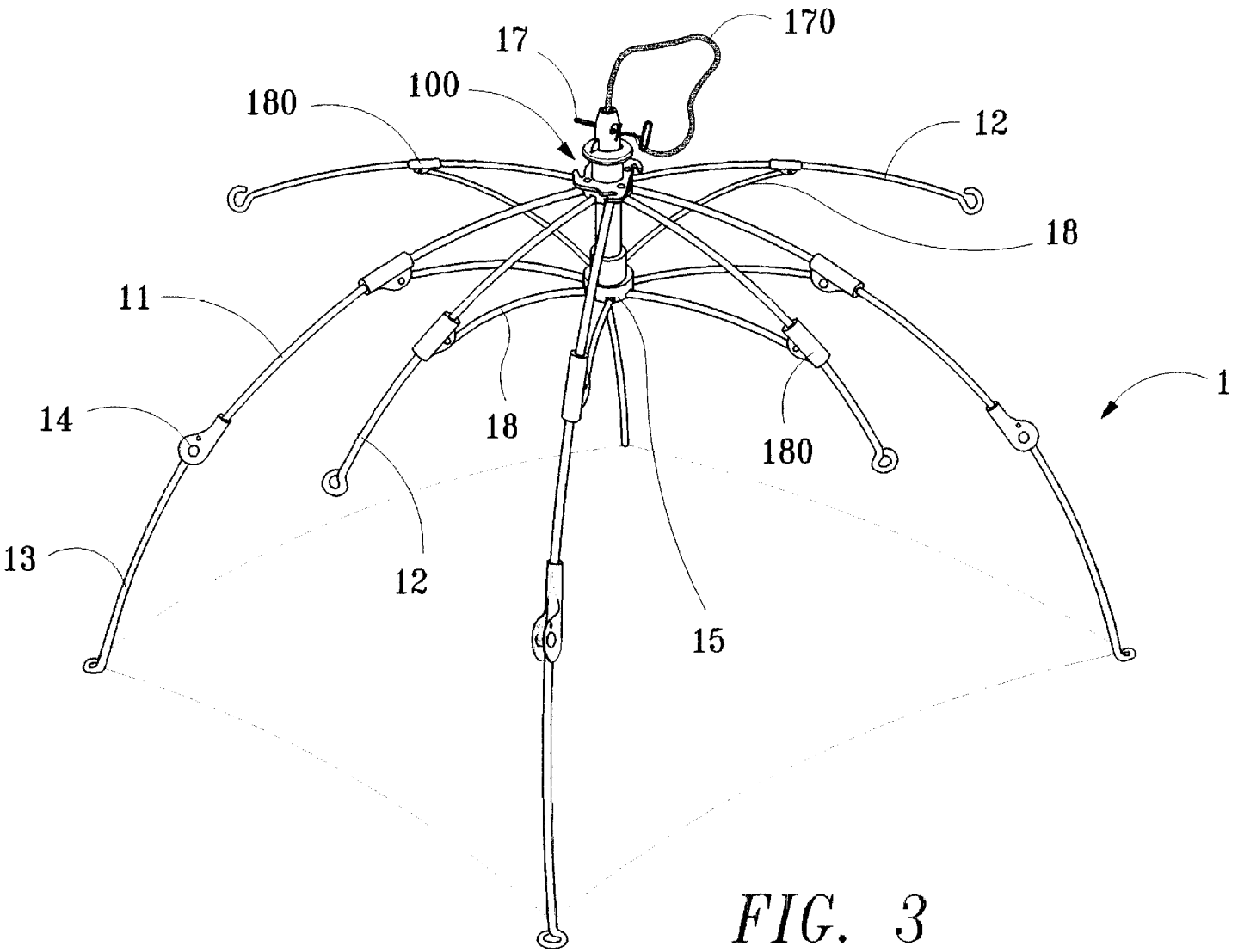
FIG. 3 is the expanded view of the present invention.
Figure 4:
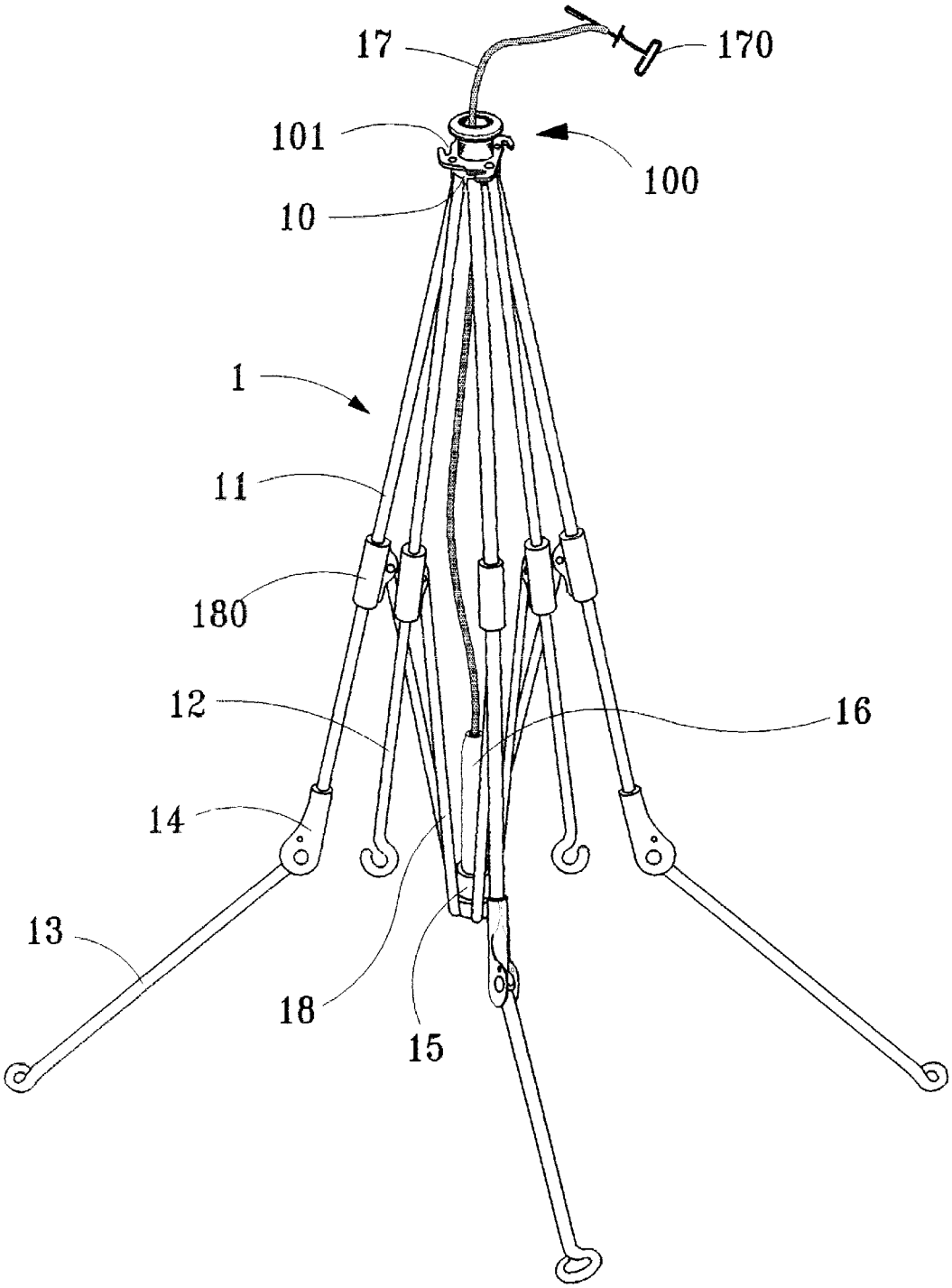
FIG. 4 shows the folded framework of the present invention.
Figure 5:
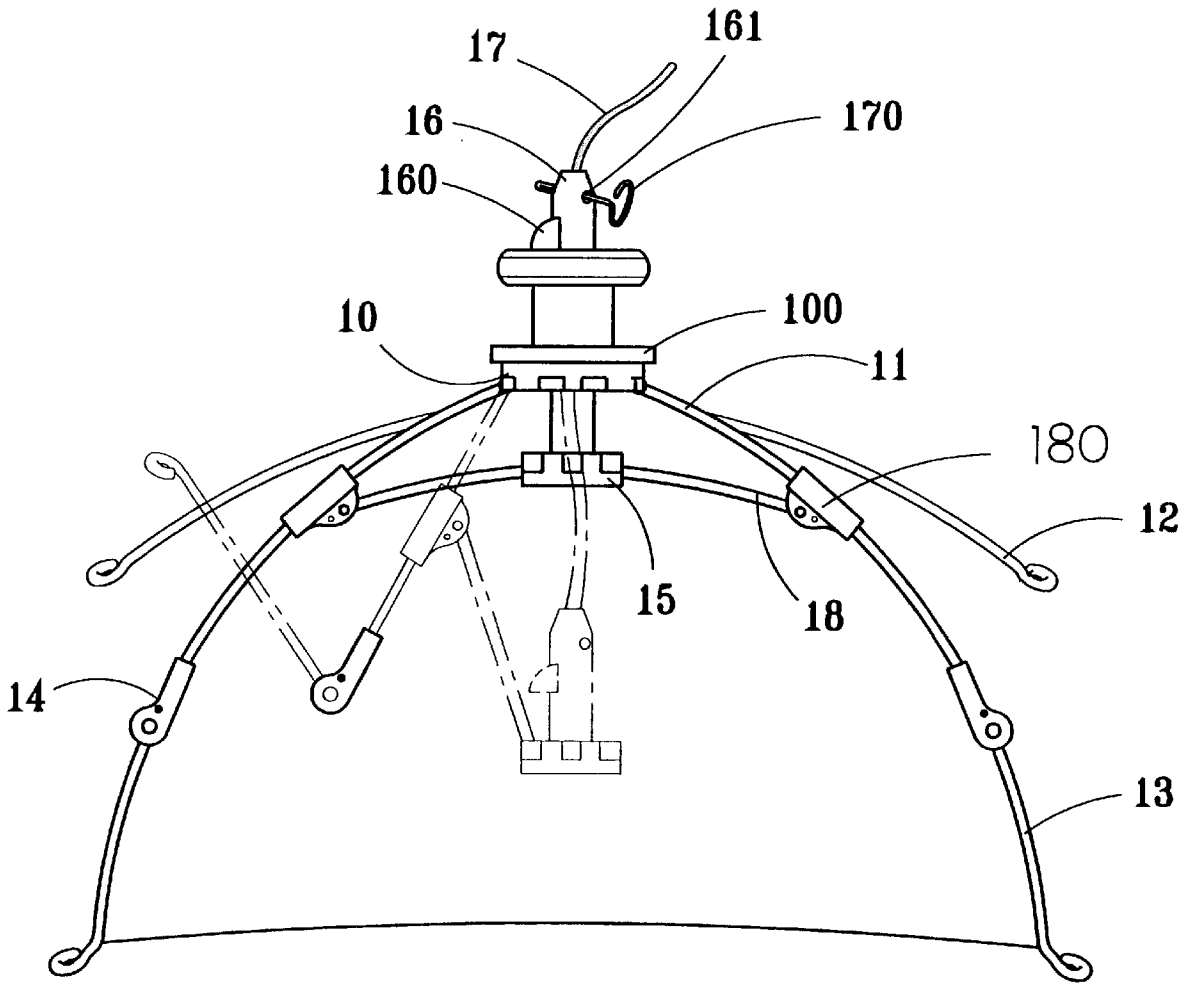
FIG. 5 shows the embodiment of the present invention.

Now referring to FIGS. 1 to 3, the present invention is comprised of a framework 1, an umbrella surface 2, a tent cloth 3, wherein the framework 1 is installed on the outside of the tent cloth 3 for supporting the body of the present invention, an upper nest 10 is installed on the center of the framework 1 and a fixing ring 100 is installed on the upper end of the upper nest 10 and a plurality of fixing grooves 101 which is used to fix lower primary frame 13 are installed on the periphery of the fixing ring 100, thus the present invention may be conveniently folded, while on the periphery of the upper nest 10 is installed with a plurality of upper primary frame 11 on each sides of which is installed with an umbrella vice frame 12, by the coupling therebetween, the umbrella surface may be easily supported. A connector 14 is connected to the distal end of the upper primary frame 11, and the opening of each connector are directed upwards. Within the connector 14 is installed with a lower primary frame 13 which may be bent upwards without using for saving the volume of the tent after being folded. Another a lower nest 15 is installed under the upper nest 10, and a plurality of branch frame 18 are installed on the periphery of the lower nest 15, and each of the branch frame 18 is connected with the lower primary frame 11 and the umbrella vice frame 12 by the distal end of the branch frame 18 for driving the lower primary frame 11 and umbrella vice frame to open and close. A combining pillar 16 is installed on the center of the lower nest 15 and a combining button 160 is installed on the combining pillar 16, while a coming hole 161 is installed on the combining button 160. Further, a controlling rope 17 are extended outwards form the combining pillar 16 and the distal end of the controlling rope 17 is connected with a safety pin 170. As the present invention is supported in usage, the fixing pin 170 is used to insert into the combining hole 161 of the combining pillar 16 to prevent that the combining pillar 16 will release or collapse by accident.

Further, the umbrella surface 2 is suspended from a hook 19, or by sewing, tying or buttons so to support between the upper primary frame 11 and the umbrella vice frame 12, thus the sunlight and raining water will not leak into the tent 3 directly, therefore, the inner space of the tent will sustain in a dry and clear condition, or the snow will not apply pressure directly on the tent 3 to cause that the tent will collapse.

The tent cloth is suspended by a hook 19, or by sewing, tying or buttons so to suspend within the framework 11, thus to form a sealing and sewing structure, and it is wind and rains, or bugs will not enter the tent. The tent cloth 3 and the umbrella surface 2 may be manufactured by fireproof material.

Now referring to FIGS. 3 to 6, in using of the present invention, it is only needed to pull the control rope 17, through the inside of the upper nest 10, the combining pillar 16 will be pulled out so that the combining button 160 are buckled on the top end of the upper nest 10, therefore, the lower nest 15 will be pulled by the combining pillar 16 and the branch frame 18 is driven by the lower nest 15 so that the upper primary frame 11 is expanded outwards, further, the tent cloth 13 will expanded outwards by the driving of upper primary frame 11 and lower primary frame 13, thereby the tent is easily installed. Meanwhile the safety pin 170 are buckled between the combining pillar 16 and the combining hole 161 to prevent that the combining pillar 16 is slid to the outside of the upper nest 10 by accident so that the tent is collapsed. As the tent will be folded, the safety pin 170 is pulled out and the combining button 160 is pressed so that the combining pillar 16 will slide to the outside of the upper nest 10 to cause that the whole framework is released, further, the lower primary frame 13 is bent upwards and then is engaged within the fixing groove 101 of the fixing ring 100, therefore, the tent is folded completely and it is easy to carry.

Figures 6, 7A, 7B:
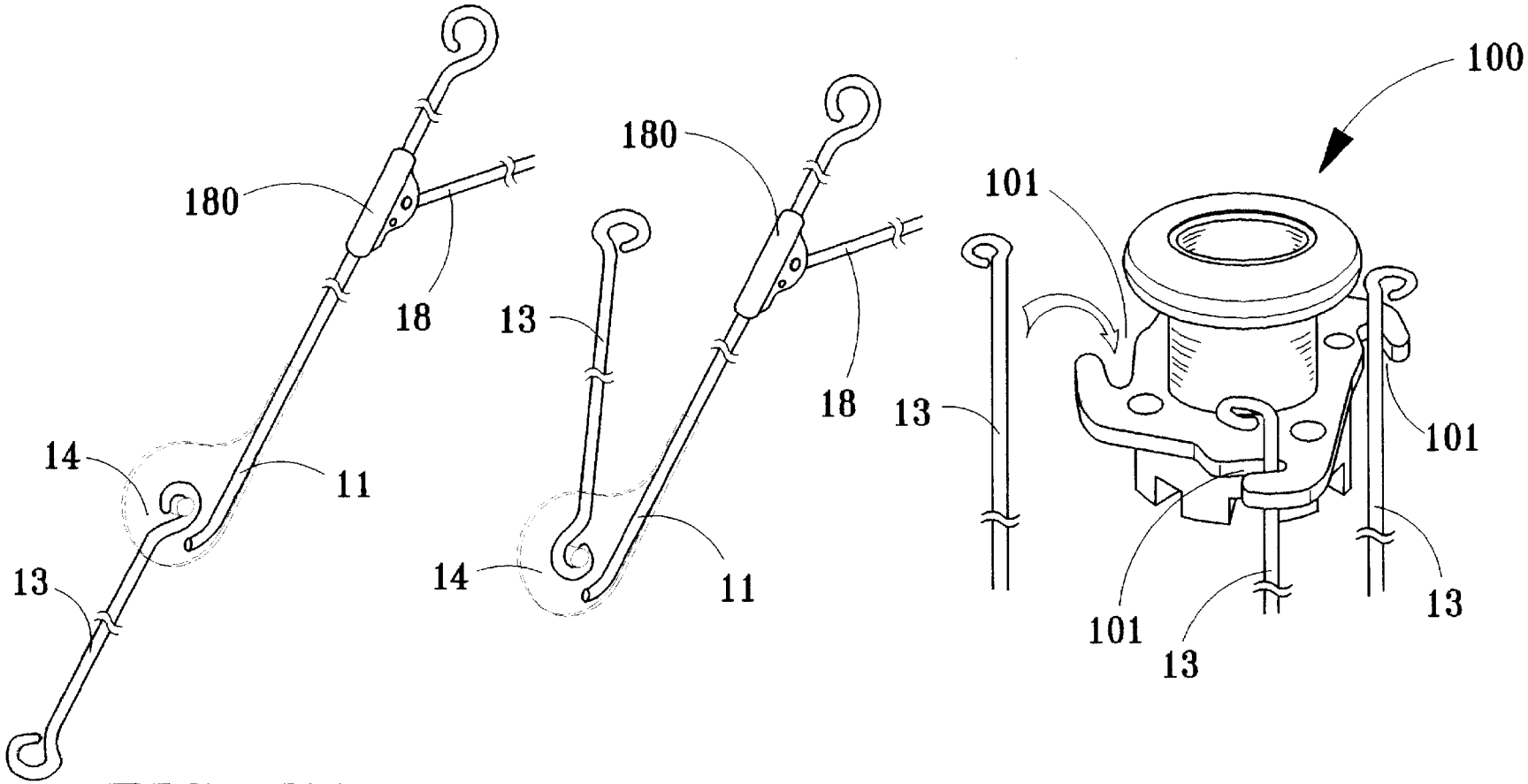
FIG. 6 shows an operating example in a fixing environment of the present invention.
FIG. 7A is an expanding view of the connector in the present invention.
FIG. 7B is a folded view of the connector in the present invention.

Now referring to FIGS. 7(A) and 7(B), the distal end of the upper primary frame 11 of the present invention is bent upwards to resist against the lower primary frame 13 so that as the lower primary frame 13 is bent downwards, the force will disperse uniformly through the upper primary frame 11 and will not direct press the thin wall surface of the connector 14 so to destroy the connector 14.

Although certain preferred embodiment of the present invention has been shown and described in detail, it should be understood that various changes and modification may be made therein without departing from the scope of the appended claims.

| | |
|---|---|
| 1 | framework |
| 2 | umbrella surface |
| 3 | tent cloth |
| 10 | upper nest |
| 11 | upper primary frame |
| 12 | umbrella vice frame |
| 13 | lower primary frame |
| 14 | connector |
| 15 | lower nest |
| 16 | combining pillar |
| 17 | controlling rope |
| 18 | branching frame |
| 19 | ring |
| 100 | fixing ring |
| 101 | fixing groove |
| 160 | combining button |
| 161 | combining hole |
| 170 | safety pin |
| 180 | node |

What is claimed is:

1. An umbrella shape two layers foldable tent, comprising:

a framework which comprises an upper nest, which is located at the center of the framework, having a plurality of fixing grooves is provided along the periphery of the upper nest, a fixing ring installed on an upper end of the upper nest, a plurality of upper primary frames and a plurality of umbrella vice frames respectively installed on the periphery of the upper nest, a plurality of connectors respectively each installed to a distal end of each of the upper primary frames with an opening of each of the connectors directing upwards, and a plurality of lower primary frames which are pivotally connected to the connectors respectively, wherein each of the umbrella vice frames is located between two of the upper primary frames and the lower primary frames are capable of bending upwards to engage with the fixing ring;

a lower nest installed under the upper nest;

a plurality of branch frames which are installed on the periphery of the lower nest and each has a distal end, wherein the distal ends of the branch frames are respectively connected with the upper primary frames and the umbrella vice frames;

a combining pillar, which is installed on the lower nest, comprising a combining button installed thereon; and a controlling rope extended upwards from the combining pillar;

a tent cloth which is installed inside of the framework and supported by the upper primary frames, the lower primary frames and the branches frames; and an umbrella surface supported on the upper primary frames and the umbrella vice frames for preventing sunlight, rain water and snow from directly contact with the tent cloth, such that the umbrella surface is spaced from the tent cloth and covers the tent cloth;

wherein when the controlling rope is pulled through the upper nest, the combining pillar is pulled out so that the combining button is buckled on the upper end of the upper nest, and thus the lower nest is pulled by the combining pillar and the branch frames are driven by the lower nest, so that the upper primary frame is expanded outwards and the tent cloth is also driven to expand outwards by the upper primary frames and the lower primary frames, wherein when the combining button is pressed, the combining pillar slides outside of the upper nest to release the framework, so as to fold the umbrella shape two layers foldable tent.

2. The umbrella shape two layers foldable tent, as claimed in claim 1, wherein the distal ends of the upper primary frames are slightly bent upwards as the lower primary frames are bent downwards and directly contact with the upper primary frames, so as to prevent the tensile force of each of the lower primary frames from directly contact with the respective connector.

3. The umbrella shape two layers foldable tent, as claimed in claim 1, wherein a plurality of nodes are respectively mounted on the upper primary frames for connecting with the branch frames respectively, and that the tent cloth further comprises a plurality of hooks attached thereon for connecting with the nodes respectively.

4. The umbrella shape two layers foldable tent, as claimed in claim 1, wherein umbrella surface and tent cloth are manufactured by fireproof material so as to increase the fireproof and heat isolation ability thereof.

5. The umbrella shape two layers foldable tent, as claimed in claim 1, wherein the combining pillar has a combining hole provided on an upper end thereof and a safety pin is inserted is inserted into the combining hole to prevent the combining pillar from sliding down from inside of the upper nest.

6. The umbrella shape two layers foldable tent, as claimed in claim 1, wherein a fixing ring has a plurality of fixing grooves provided along the periphery of the fixing ring, so that when the umbrella shape two layers foldable tent is folded, the lower primary frames are bent to engage with the fixing ring by burying into the fixing grooves of the fixing ring respectively.

* * * * *